United States Patent [19]

Vieux et al.

[11] Patent Number: 4,803,366

[45] Date of Patent: Feb. 7, 1989

[54] INPUT SCREEN SCINTILLATOR FOR A RADIOLOGICAL IMAGE INTENSIFIER TUBE AND A METHOD OF MANUFACTURING SUCH A SCINTILLATOR

[76] Inventors: Gérard Vieux, Pré de l'Achard 38330, St. Nazaire les Eymes; Henri Rougeot, 5, rue Marcel Porte 38100, Grenoble, both of France

[21] Appl. No.: 897,938

[22] Filed: Aug. 19, 1986

[30] Foreign Application Priority Data

Aug. 23, 1985 [FR] France ..... 85 12688

[51] Int. Cl.[4] ..... H01J 1/62

[52] U.S. Cl. ..... 250/486.1; 250/483.1

[58] Field of Search ..... 250/483.1, 484.1, 486.1, 250/487.1

[56] References Cited

U.S. PATENT DOCUMENTS

| | | | |
|---|---|---|---|
| 3,838,273 | 9/1974 | Cusano | 250/213 VT |
| 4,069,355 | 1/1978 | Lubowski et al. | 427/70 |
| 4,100,455 | 7/1978 | Suffredini et al. | 313/101 |
| 4,101,781 | 7/1978 | Neukermans et al. | 250/483.1 |
| 4,398,118 | 8/1983 | Galves et al. | 250/483.1 |
| 4,504,738 | 3/1985 | Noji et al. | 250/483.1 |

FOREIGN PATENT DOCUMENTS

| | | | |
|---|---|---|---|
| 0042149 | 12/1981 | European Pat. Off. . | |
| 2360989 | 8/1976 | France . | |
| 0032649 | 4/1981 | Japan | 250/483.1 |

*Primary Examiner*—Bruce C. Anderson
*Assistant Examiner*—Paul A. Guss
*Attorney, Agent, or Firm*—Cushman, Darby & Cushman

[57] ABSTRACT

The present invention provides an input screen scintillator for a radiological image intensifier tube in which the cesium iodide needles of the scintillator are coated with a refractory, transparent of reflecting, material having an optical index close to or less than that of the cesium iodide. Different methods may be used for coating, such as chemical vapor phase deposition, activated by thermal excitation, plasma excitation or photonic excitation; or such as diffusion deposition of a colloidal solution; or such as polymerization of a polymer resin. After coating, is realized the heat treatment which ensures the luminescence of the screen.

13 Claims, 2 Drawing Sheets

INPUT SCREEN SCINTILLATOR FOR A RADIOLOGICAL IMAGE INTENSIFIER TUBE AND A METHOD OF MANUFACTURING SUCH A SCINTILLATOR

BACKGROUND OF THE INVENTION

1. Field of the Invention

The present invention relates to an input screen scintillator for a radiological image intensifier tube. It also relates to a method of manufacturing such a scintillator.

2. Description of the prior art

Radiological image intensifier tubes are well known in the prior art. They allow a radiological image to be transformed into a visible image, generally for allowing medical observation.

These tubes are formed by an input screen, an electronic optical system and an observation screen.

The input screen comprises a scintillator which converts the incident X ray photons into visible photons. These visible photons then strike a photocathode, generally formed by an alkaline antimonide which, thus excited, generates an electron flow. The photocathode is not deposited directly on the scintillator but on an electrically conducting underlying layer which allows the charges of the material of the photocathode to be reconstituted. This underlying layer may for example be formed of alumina, indium oxide or a mixture of these two substances.

The electron flow from the photocathode is then transmitted by the electronic optical system which focuses the electrons and directs them onto an observation screen formed of a luminograph which then emits a visible light. This light may then be processed, for example, by a television, cinema or photograph system.

The scintillator of the input screen is generally formed of cesium iodide deposited by vacuum evaporation on a substrate. The evaporation may take place on a cold or hot substrate. The substrate is generally formed by an aluminum skull-cap shaped piece with spherical or hyperbolic profile. A thickness of cesium iodide is deposited which is generally between 150 and 500 micrometers.

The cesium iodide is naturally deposited in the form of needles having a diameter of 5 to 10 micrometers. Since its refraction index is 1.8, it benefits from a certain optical fiber effect which minimizes the lateral diffusion of the light generated within the material.

In FIG. 1 an aluminum substrate 1 has been shown schematically having a few cesium iodide needles 2. The aluminum substrate receives a flow of X ray photons symbolized by vertical arrows. There have been shown with broken lines in the Figure examples of paths followed in the cesium iodide needles by the visible radiation corresponding to the incident X ray photons. The normal paths, which bear the reference 3, cause the production of a light signal at the end of the cesium iodide needles. There is also diffusion laterally of the light conveyed by the cesium iodide needles, as is shown in the Figure with the reference 4.

The resolution of the tube depends on the capability of the cesium iodide needles to correctly channel the light. It depends on the thickness of the cesium iodide layer. An increase in thickness causes a deterioration of the resolution. But, on the other hand, the greater the thickness of cesium iodide the more the X rays are observed. A compromise must then be found between the absorption of the X rays and the resolution.

Another factor which influences the resolution of the tube is the heat treatment which the input screen must undergo during manufacture thereof. This treatment takes place immediately after the vacuum evaporation of the cesium iodide. It ensures the luminescence of the screen because of the doping of the cesium iodide by sodium or thalium ions for example. This heat treatment generally consists in heating the screen to a temperature of about 340° C. for about an hour, while placing it in a dry air or nitrogen atmosphere.

The problem which arises is that, during this absolutely obligatory heat treatment, the needles of the scintillator undergo a certain coalescence and agglomerate together, as has been shown schematically in FIG. 2. This coalescence causes greater lateral diffusion of the light, see the broken line arrows bearing the reference 4, and the resolution is deteriorated.

To overcome the coalescence which occurs during the heat treatment, it was proposed in the prior art to form the scintillator of the input screen by alternately evaporating pure cesium iodide and cesium iodide doped with a refractory material. It was hoped that needles thus formed by alternate layers of pure cesium iodide and cesium iodide doped with a refractory material would not come into contact during heat treatment. This solution has not given the expected results.

SUMMARY OF THE INVENTION

The present invention proposes overcoming the problem raised by the heat treatment in the following way. According to the invention, the cesium iodide needles of the scintillator are coated with a refractory material, transparent or reflecting, and having an optical index close to or lower than that of cesium iodide. Because of this coating, no coalescence of the needles is observed during the heat treatment which follows the coating and which ensures the luminescence of the screen.

BRIEF DESCRIPTION OF THE DRAWINGS

The following description is illustrated by:

FIGS. 1 and 2 have been described in the introduction and the description.

DESCRIPTION OF THE PREFERRED EMBODIMENT

Figure 1:
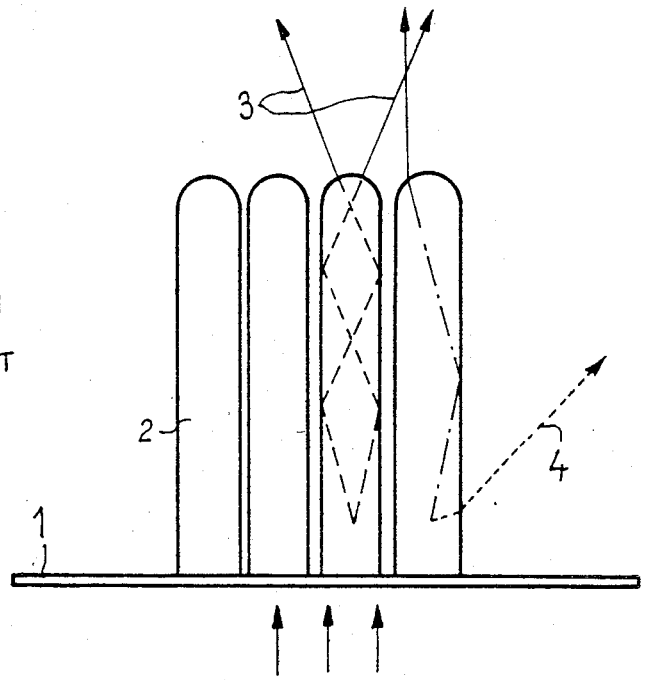
FIG 1 PRIOR ART
FIGS. 1 and 2, two diagrams showing an input screen scintillator for a radiological image intensifier tube of the prior art.
Figure 2:
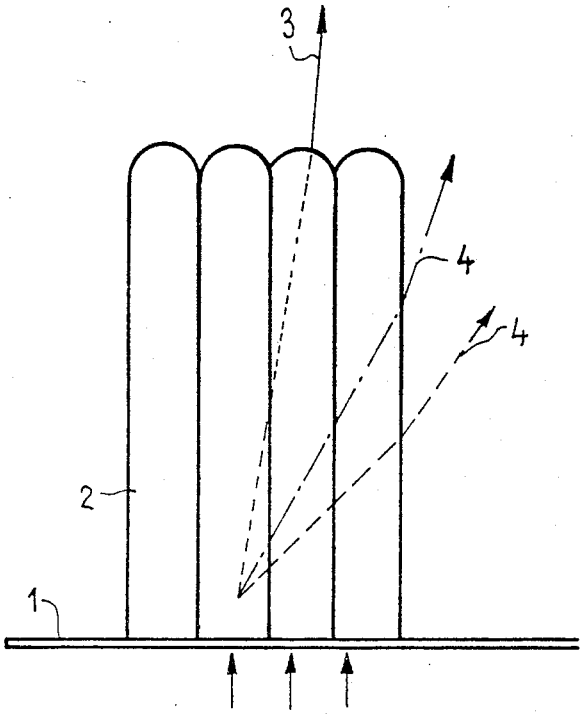
FIG 2 PRIOR ART
Figure 3:
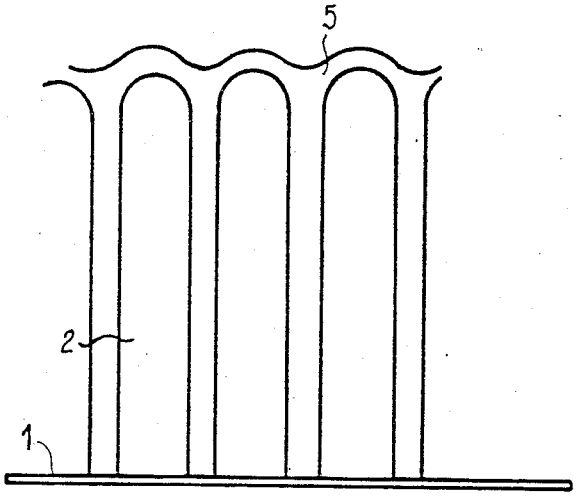
FIG. 3, a diagram showing the input screen scintillator for a radiological image intensifier tube of the invention.

FIG. 3 shows schematically an input screen scintillator for a radiological image intensifier tube of the invention. As in FIGS. 1 and 2, a substrate 1 has been shown, made from aluminum, for example, carrying some cesium iodide needles. According to the invention, needles 2 are coated with a refractory transparent material 5 having an optical index close to or less than that of cesium iodide.

The needles are therefore coated with a material which comes into the gaps between the needles and which acts as a mechanical barrier by keeping the needles isolated from each other during the heat treatment. which follows the coating and which ensures the luminescence of the screen.

This material must be refractory, that is to say have as high a melting point as possible so as not to be affected by the heat treatment. It must be transparent or reflecting so as not to absorb the light. Finally, this material must have an optical index close to or less than that of cesium iodide so as to keep an optical fiber effect.

The method used for forming this coating determines the nature of the material used as will be seen hereafter. Thus, the coating material 5 may be an oxide of a metal or of a non metal, a polymerizable resin of the silicon type, an organo-metallic compound etc...

Figure 4:
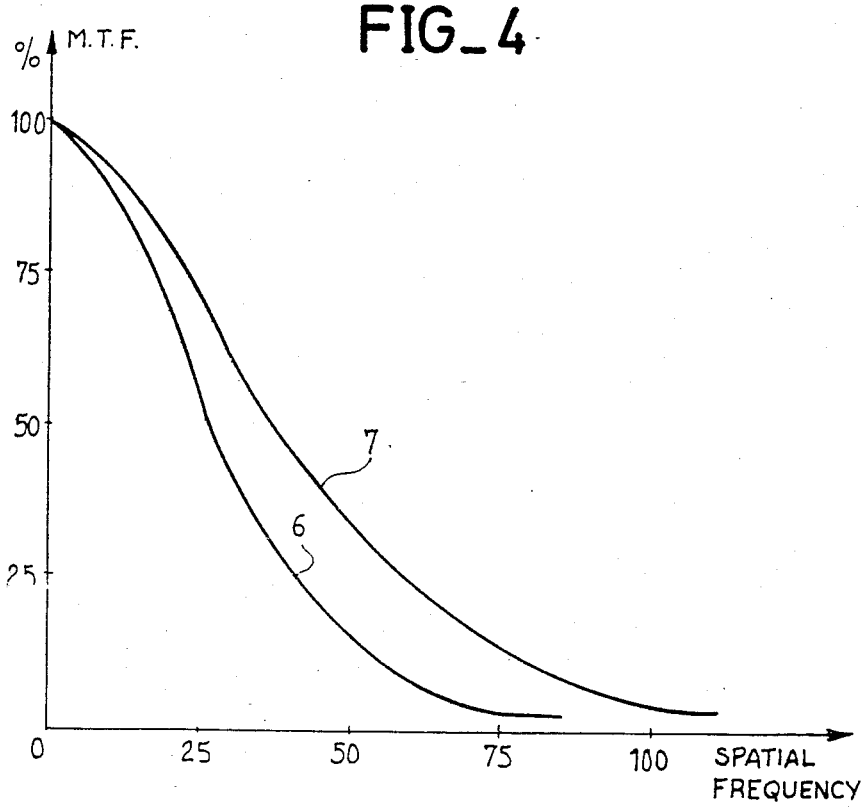
FIG. 4, two curves showing the improvement of the modulation transfer function (M.T.F.) brought by the invention.

In FIG. 4, curves 6 and 7 show, as a function of the spatial frequency, in pairs of lines by centimeter, that the modulation transfer function (M.T.F), in percentage is higher in the case of the scintillator of the invention, curve 7, than in the case of a scintillator of the prior art, shown in FIG. 6. The invention allows then a high resolution and a high M.T.F. to be obtained.

Different methods may be used for forming the screen of the invention. One of these methods is a chemical deposit in the vapor phase, currently called C.V.D. for "chemical vapor deposition". This method is currently used in the semiconductor field for depositing material in a thin layer on a flat substrate. According to the ivention, this method is used for depositing material in a thin layer on an essentially vertical substrate formed by each needle of the scintillator. It should be emphasized that the difficulty of coating the needles comes from the fact that the gaps between needles have a great length with respect to their diameter, their length being approximately a thousand times greater than their diameter.

The coating material deposited by this method may be any oxide of a metal of a non metal which is refractory, transparent or reflecting, and having an optical index close to or less than that of cesium iodide. The coating material used may have one of the following formulae : Si O, Si $O_2$, Si $O_x$ with $1<x<2$, $Al_2O_3$,$Sb_2O_5$....

Different variants of the C.V.D. process may be used. In these variants, activation of the C.V.D. process is provided in different ways.

Thus, activation of the C.V.D. process may be achieved by thermal excitation: that is to say the high temperature C.V.D. It takes place initially in a vacuum then at atmospheric pressure. A reactive vapor phase deposition is formed using a mixture of gases such as silane Si $H_4$, oxygen and nitrogen oxide $N_2O$. The molecules of the mixtures recombine so as to form the silica $SiO_2$ which is deposited on the caesium iodide needles. It is also possible to deposit silicon nitride $Si_3N_4$ by the same type of process. The high temperature C.V.D. involves using a temperature higher than 300° C.

Activation of the C.V.D. process may also be achieved by plasma excitation, at about 100° C., or by photonic excitation, at about 100° C. as well. In the case of photonic excitation, the coating layer may be silicon nitride $Si_3N_4$. Activation of the C.V.D. process may also be achieved by using a high temperature plus low pressure process (LPCVD technique).

Another method for forming the screen of the invention may be coating by diffusion of a colloidal solution inside the gaps between needles. A colloidal solution may be used of $S_iO_2$, or $Al_2O_3$, $Sb_2O_5$, $SnO_4$, for example.

Diffusion coating is followed by heat treatment which causes deposition of the coating material, for example $SiO_2$, in the case of a colloidal $SiO_2$ solution. This heat treatment may be carried out at the same time as the heat treatment causing the luminescence of the cesium iodide needles.

Another method for forming the screen of the invention is vacuum coating using a polymer resin of the silicon type or any polyimide material. Hardening of the coating material takes place either at ambient temperature, or hot.

A last method consists in forming the coating by diffusing an organo-metallic compound in the gaps between the needles. As example of such a compound tetra-methoxy-silane, tetra-ethoxy -silane or silicon-tetra-acetate may be mentioned. This organo-metallic compound must undergo a high temperature treatment or air hydrolysis.

What is claimed is:

1. An input screen scintillator for a radiological image intensifier tube comprising a layer of juxtaposed cesium iodide needles having lateral sides extending transversally to said layer, said layer including gaps between the needles, wherein said needles are coated with a refractory material on their lateral sides within the gaps, and wherein said refractory material is transparent and has an optical refractive index approximately the same or less than that of said cesium iodide needles.

2. A method of manufacturing an input screen scintillator for a radiological image intensifier tube, comprising the steps of:

forming a layer of juxtaposed cesium iodide needles having lateral sides extending transversally to said layer, said layer having gaps between the needles;

coating the lateral sides of the needles within the gaps with a transparent refractory material; wherein said refractory material has an optical refractive index approximately the same or less than that of said cesium iodide needles and thereafter heat treating said input screen in order to insure the luminescence thereof.

3. The method of claim 2, wherein said transparent refractory material has an optical index approximately the same or less than that of the cesium iodide needles.

4. An input screen scintillator according to claim 1, wherein the material for coating the needles is an oxide of a metal or of a non metal.

5. An input screen scintillator according to claim 1, wherein the coating material is selected from the group consisting of SiO, $SiO_2$, $SiO_x$ with $1<x<2$, $Al_2O_3$, $Sb_2O_5$, $Si_3N_4$, $S_nO_4$.

6. The method of claim 2, wherein the step of coating the needles includes depositing said coating material by chemical vapor phase deposition.

7. The method of claim 2, wherein the step of coating the needles includes depositing said coating material by chemical vapor phase deposition, activated by thermal excitation, one of the following coating materials being used : $SiO_2$, $Si_3N_4$.

8. The method of claim 2, wherein the step of coating needles includes depositing said coating material by chemical vapor phase deposition, activated by one of the following techniques : plasma excitation, photonic excitation, use of low pressure and high temperature.

9. The method of claim 2, wherein the step of coating the needles includes depositing said coating material by diffusion of a colloidal solution inside the gaps between needles, followed by heat treatment causing deposition of the coating material.

10. The method of claim 9, wherein said colloidal solution is selected from the group consisting of $SiO_2$, $Al_2O_3$, $Sb_2O_5$, $SnO_4$.

11. The method of claim 2, wherein the step of coating the needles includes having said cesium iodide needles coated in a vacuum with a polymer resin of the silicon type or any other polyimide material, and subsequent hardening of the coating material.

12. The method of claim 2, wherein the step of coating the needles includes having said cesium iodide needles coated by diffusion, between the needles, of an organo-metallic compound then undergoing one of the following treatments: high temperature, treatment air hydrolysis.

13. The method of claim 12, wherein said organo-metallic compound is selected from the group consisting of tetramethoxy-silane, tetra-ethoxy-silane, silicon tetra-acetate.

* * * * *